United States Patent [19]

Boonstra et al.

[11] 4,107,387

[45] Aug. 15, 1978

[54] RESISTANCE MATERIAL

[75] Inventors: Alexander Hendrik Boonstra; Cornelis Adrianus H. A. Mutsaers, both of Eindhoven, Netherlands

[73] Assignee: U.S. Philips Corporation, New York, N.Y.

[21] Appl. No.: 775,457

[22] Filed: Mar. 8, 1977

[30] Foreign Application Priority Data

Mar. 15, 1976 [NL] Netherlands ..... 7602663

[51] Int. Cl.[2] ..... H01B 1/08

[52] U.S. Cl. ..... 428/426; 428/539; 252/518; 252/521

[58] Field of Search ..... 252/521, 518; 423/593; 428/411, 539, 426

[56] References Cited

U.S. PATENT DOCUMENTS

| | | | |
|---|---|---|---|
| 3,553,109 | 1/1971 | Hoffmann | 423/593 X |
| 3,630,969 | 12/1971 | Popowich | 252/521 X |
| 3,681,262 | 8/1972 | Bouchard | 252/520 |

*Primary Examiner*—Brooks H. Hunt
*Assistant Examiner*—E. Suzanne Parr
*Attorney, Agent, or Firm*—Frank R. Trifari; Daniel R. McGlynn

[57] ABSTRACT

A resistance material consisting of a mixture of metal oxide and/or metal oxidic compounds and any metals with a binder, which material comprises a metal rhodate of the type $M_3Rh_7O_{15}$, by way of resistance determining component. This material has a small negative TCR which is substantially constant in a large temperature range.

13 Claims, No Drawings

RESISTANCE MATERIAL

The invention relates to a resistance material consisting of a mixture of a binder and metal oxides and/or metal oxidic compounds and, optionally, metals.

Such a material is known, for example, from U.S. Pat. Nos. 3,681,262, 3,630,969 and 3,553,109. To prepare the material, compounds of noble metals decomposing upon heating, noble metal resinates in particular and, optionally, in place thereof or next to them noble metal oxides are mixed with special kinds of pulverent glass which contain PbO and/or $Bi_2O_3$ together with an organic binder and the mixture is fired in the form of, for example, conductors on a substrate at a temperature of at least 600° C. During firing all kinds of reactions take place. In the first place the organic part of the metal compound or compounds and the organic binder is burnt and/or volatilizes, the PbO and/or $Bi_2O_3$ in the glass reacts with a noble metal oxide while forming a compound and oxidation and reduction reactions to higher metal oxides or free metals respectively may occur. Suitable noble metals are Au, Rh, Ru, Pt, Pd, Os, Ag and Ir. One type of compound which is formed in many of the reactions is the pyrochlore type of the general formula $M'_2M''_2O_{6-7}$ wherein M' = Pb, Bi, Cd, La, Y etc. and M'' = Au, Re, Rh, Pt, Ir, Ge etc.

These pyrochlore compounds comprise compounds having a metallic conductivity. As a rule their resistance increases linearly when the temperature is increased. Other representatives of these compounds exhibit a semiconductor behaviour which as a rule includes a negative temperature coefficient of the resistance (TCR). With these semiconductive compounds the resistance varies with the temperature in accordance with an e-function. As a rule, with a resistor body of the present type there are mixtures of different conductivity types whose total resistance varies non-linearly owing to the component having such an e-function. In practice given resistance levels are desired, the temperature function of which is preferably linear.

As described above a resistor having a positive TCR poses as a rule no problem as regards linearity, in contrast to resistors having a negative TCR.

The invention provides a resistive material which does not have a pyrochlore structure, which has a small negative temperature coefficient of the resistance, which TCR is substantially constant over a very large temperature range (−190 to +200° C). This offers in practice a large number of possibilities as regards the possibility to obtain resistors of different levels, namely by mixing with any other material having a positive TCR and/or by "diluting" with glass any required level of the resistance with any desired linear variation of the resistance as a function of the temperature can be obtained.

The resistance material according to the invention is characterized in that it comprises by way of resistance determining component a metal rhodate of the composition $M_3Rh_7O_{15}$. A preferred composition relates to material which comprises the component $M_3Rh_7O_{15}$ and wherein M is chosen from Pb or Sr.

It was originally thought that the composition of the relevant compound was $MRh_2O_5$. However it was found afterwards, after radiographical examinations, that the structure was $M_3Rh_7O_{15}$.

As indicated above a further elaboration of the invention consists in that the resistance material comprises, in addition, a component having a positive temperature coefficient of the resistance, in such a quantity that a desired level of the TCR is achieved with it.

When incorporating resistance material having a positive TCR preference is given to material of the type $M'_2M''_2O_{6-7}$, wherein M' = Pb and M'' = Ru, Os or Ir. However, it is also possible to use metal powder or a metallically conducting metal oxide such as $RuO_2$.

An advantage of the resistance-determining component $M_3Rh_7O_{15}$ is that it need not be formed in situ by a reaction with a vitreous binder but that it is even preferably formed separately from the elements, the oxides or compounds which are converted into oxides by means of firing, for example by firing a mixture of PbO and $Rh_2O_3$ to a temperature of over 700° C. The component obtained may then be fired, either alone or mixed with another resistor component with a binder to a temperature which may be considerably lower than 600° C. When preparing the product according to the invention the binder does not play a part in the forming reaction. Consequently it even need not be any low-melting point glass but may even be a polymer.

As the resistor body can be produced at a much lower temperature than in the prior art embodiments one is no longer limited, when using the invention, to heat-resistant ceramic substrate materials such as $Al_2O_3$ or steatite, but also cheaper materials such as resin impregnated laminated sheet can be used as a substrate.

The invention will be illustrated by means of the following examples.

EXAMPLE I

Glass powder having an average particle size of 1 μm and having a composition in wt.%

| | | | |
|---|---|---|---|
| PbO | 71.7 | $SiO_2$ | 21.0 |
| $B_2O_3$ | 5.0 | $Al_2O_3$ | 2.3 |

is stirred with a silver sol which comprises 8 mg Ag/ml in which the average size of the silver particles is 100 A, in a ratio of 1 g of glass powder per 20 ml of silver sol. The suspension obtained is filtered and dried. The silver particles remain behind, substantially quantitavely, adsorbed at the surface of the glass particles.

The powder 3obtained is mixed with lead rhodate $Pb_3Rh_7O_{15}$ which has an average particle size of 0.1 to 0.2 μm in the weight ratio glass: $Pb_3Rh_7O_{15}$ = 2 : 1, by means of benzylbenzoate this is made into a paste which is spread into a layer of approximately 20 μm thick on an alundum ($Al_2O_3$) substrate. The assembly is dried and thereafter heated to 700° C for 10 minutes. After cooling leads are applied to the resistive layer by means of silver paste and the surface resistance and the temperature coefficient of the resistance (TCR) is determined. They are, respectively, 60 Ohm/square and TCR + 40 $\times 10^{-6}$ °C$^{-1}$ measured between −40 and +170° C.

EXAMPLE II

Glass powder with adsorbed silver, prepared in accordance with the example I is mixed with $Pb_3Rh_7O_{15}$ having the same particle size in the ratio by weight 4 : 1 and processed in a similar manner into a resistive element. The measured value and the surface resistance amount to 700 Ohm per square and the TCR − 30 $\times 10^{-6}$ °C$^{-1}$ measured between −40 and +190° C.

EXAMPLE III

Lead rhodate powder ($Pb_3Rh_7O_{15}$) having an average particle size of 0.1 to 0.2 μm, leadruthenate ($Pb_2Ru_2O_7$) having an average particle size of 0.2 μm and glass powder prepared in accordance with Example I are mixed in a ratio by weight 2 : 3 : 10, a paste is made of the mixture, this paste is spread on an $Al_2O_3$ substrate, the assembly is dried and fired in an oven for 5 minutes at 800° C. After applying the leads the value of the resistance measured at room temperature is 1.5 kOhm per square and the TCR is less than $+20 \times 10^{-6}$ °C$^{-1}$ in the temperature range between −50 and +200° C.

EXAMPLE IV

The same components as in Example III are mixed in a weight ratio $Pb_3Rh_7O_{15}$ : $Pb_2Ru_2O_7$ : glass powder of 1 : 3 : 12. The firing time is 10 minutes and the temperature 700° C. The measured value of the resistance is 12 kOhm per square and the TCR: $-40 \times 10^{-6}$ °C$^{-1}$ in the temperature range between −50 and +180° C.

EXAMPLE V

The same components as in Example III are mixed in a weight ratio $Pb_3Rh_7O_{15}$ : $Pb_2Ru_2O_7$ : glass powder of 1 : 3 : 4. The powder obtained is again made into a paste with benzylbenzoate, spread on an $Al_2O_3$ substrate, dried, fired for 10 minutes at 700° C, provided with leads. The value of the surface resistance at room temperature is 50 Ohm per square and the TCR, measured between −50 and +200° C : $+30 \times 10^{-6}$ °C$^{-1}$.

EXAMPLE VI

Finally, this example serves to illustrate that it is possible to obtain either a resistor body having a negative TCR or a resistor body having a positive TCR. The pulverulent components $Pb_3RH_7O_{15}$, $Pb_2Ru_2O_7$ and separated glass powder are mixed according to Example I and thereafter processed as described in the above-mentioned examples. The mixing ratio 4 : 4 : 12 results in a resistance of 1 kOhm/square with a TCR of $-200 \times 10^{-6}$ °C$^{-1}$ (−190 to +200° C) and the ratio 1 : 7 : 12 results in a resistance of 200 Ohm/square with a TCR of $+200 \times 10^{-6}$ °C$^{-1}$ (−190 to +200° C).

What is claimed is:

1. A resistance material, consisting of a mixture of a glass binder and metal oxides with a resistance-determining component comprising a metal rhodate of the composition $Pb_3Rh_7O_{15}$.

2. A material as claimed in claim 1, further comprising a compound of the type $M'_2M''_2O_{6-7}$ wherein M' is lead and M'' is a rare metal chosen from Ru, Os or Ir, having a positive temperature coefficient (TCR) in such quanity that a desired level of the TCR is achieved.

3. A material as claimed in claim 1, further comprising a $RuO_2$ component with positive TCR.

4. A resistance material, consisting of a mixture of a glass binder and metal oxides with a resistance-determining component comprising a metal rhodate of the composition $Sr_3RhO_{15}$.

5. A material as claimed in claim 4, further comprising a compound of the type $M'_2M''_2O_{6-7}$ wherein M' is lead and M'' is a rare metal chosen from Ru, Os or Ir, having a positive temperature coefficient (TCR) in such quantity that a desired level of the TCR is achieved.

6. A material as claimed in claim 4, further comprising a $RuO_2$ component with positive TCR.

7. A resistance material, consisting of a mixture of a polymeric binder and metal oxides with a resistance-determining component comprising a metal rhodate of the composition $Sr_3RhO_{15}$.

8. A material as claimed in claim 7, further comprising a compound of the type $M'_2M''_2O_{6-7}$ wherein M' is lead and M'' is a rare metal chosen from Ru, Os or Ir, having a positive temperature coefficient (TCR) in such quantity that a desired level of the TCR is achieved.

9. A material as claimed in claim 8, further comprising a $RuO_2$ component with positive TCR.

10. A resistance material, consisting of a mixture of a polymeric binder and metal oxides with a resistance-determining component comprising a metal rhodate of the composition $Pb_3RhO_{15}$.

11. A material as claimed in claim 10, further comprising a compound of the type $M'_2M''_2O_{6-7}$ wherein M' is lead and M'' is a rare metal chosen from Ru, Os or Ir, having a positive temperature coefficient (TCR) in such quantity that a desired level of the TCR is achieved.

12. A material as claimed in claim 11, further comprising a $RuO_2$ component with positive TCR.

13. A resistance body comprising a substrate to which a resistance material is adhered consisting of a mixture of a glass binder and metal oxides with a resistance-determining component comprising a metal rhodate of the composition $Pb_3Rh_7O_{15}$.

* * * * *

UNITED STATES PATENT AND TRADEMARK OFFICE

CERTIFICATE OF CORRECTION

PATENT NO. : 4,107,387

DATED : August 15, 1978

INVENTOR(S) : ALEXANDER HENDRIK BOONSTRA et al

It is certified that error appears in the above—identified patent and that said Letters Patent is hereby corrected as shown below:

Col. 4, Line 13, Claim 4, The formula should read -- $Sr_3Rh_7O_{15}$ -- .

Col. 4, Line 24, Claim 7, The formula should read -- $Sr_3Rh_7O_{15}$ -- .

Col. 4, Line 35, Claim 10, The formula should read -- $Pb_3Rh_7O_{15}$ -- .

Signed and Sealed this

*Third* Day of *November 1981*

[SEAL]

*Attest:*

GERALD J. MOSSINGHOFF

*Attesting Officer* *Commissioner of Patents and Trademarks*